US006238227B1

(12) United States Patent
Wu et al.

(10) Patent No.: US 6,238,227 B1
(45) Date of Patent: May 29, 2001

(54) ELECTRICAL CONNECTOR FOR FLEXIBLE FLAT CABLE

(75) Inventors: Ming Chuan Wu, Shun-Lin; Da Ching Lee, TaiChung, both of (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/450,936

(22) Filed: Nov. 29, 1999

(30) Foreign Application Priority Data

Sep. 23, 1999 (TW) ..... 88216270

(51) Int. Cl.[7] ..... H01R 13/62
(52) U.S. Cl. ..... 439/260; 439/607; 439/497
(58) Field of Search ..... 439/260, 267, 439/607, 609, 610, 329, 495, 497

(56) References Cited

U.S. PATENT DOCUMENTS 5,370,552 * 12/1994 Chishima et al. ..... 439/495
5,401,186 * 3/1995 Nozaki et al. ..... 439/260
5,474,468 * 12/1995 Chishima et al. ..... 439/495
5,580,272 * 12/1996 Yamaguchi et al. ..... 439/260
5,738,545 * 4/1998 Igarashi et al. ..... 439/607

* cited by examiner

*Primary Examiner*—Gary F. Paumen
(74) *Attorney, Agent, or Firm*—Wei Te Chung

(57) ABSTRACT

An electrical connector for a flexible flat cable comprises a dielectric housing defining an elongate slot, a number of terminals retained in the housing, a shield enclosing the housing, and a stuffer inserted into the slot for biasing the inserted flexible flat cable into contact with the terminals. Each terminal has a tail portion including upper and lower fingers for connecting with signal conductors of the inserted cable. The shield comprises a pressing plate extending into the slot of the housing. The pressing plate connects with a bottom wall of the shield via a pair of linkers and is parallel to the bottom wall. The stuffer comprises a body and a pair of spring latch arms formed on opposite ends thereof. A latching member is formed on an outer surface of each latch arm for guiding and locking the stuffer into the housing. The latching member includes a lead-in ramp, a locking section and a guiding rib. The lead-in ramp and the guiding rib sequentially guide the latch arm into corresponding receiving cavity of the housing. The locking section snaps over a locking member formed on an inner side surface of the receiving cavity.

1 Claim, 6 Drawing Sheets

ELECTRICAL CONNECTOR FOR FLEXIBLE FLAT CABLE

BACKGROUND OF THE INVENTION

The present invention relates to an electrical connector, and particularly to an electrical connector for a flexible flat cable having a stuffer with latching members formed thereon for guiding and locking the stuffer into a dielectric housing of the connector.

An electrical connector for a flexible flat cable, i.e. an FPC (Flexible Printed Circuit) connector, includes a dielectric housing with a plurality of terminals received therein. The housing has an elongate slot for receiving the flexible flat cable. An actuator is movably mounted on the housing for retaining the inserted cable in position and for biasing signal conductors of the cable against the terminals. There are various types of actuators, such as actuators pivotally mounted on the housing by an integral hinge portion of plastic material. Other actuators are separate or independent of the housing, such as a sliding type actuator that moves in and out of the slot in the housing along the flat cable. Pertinent prior art references are disclosed in Taiwan Patent Application Nos. 84218005, 85210257 and 83208118.

In the conventional sliding type actuator design, hook-like latches are provided for securing the actuator to the housing. Referring to FIG. 6, a conventional electrical connector for a flexible flat cable (not shown) comprises a dielectric housing 61, a plurality of terminals 62 received in the housing 61, and an actuator 63. The housing 61 defines an elongate slot 611 for receiving the flexible flat cable. A pair of receiving holes 612 are defined in opposite ends of the housing 61 in communication with a pair of locking holes 613 defined in opposite sides of the housing 61. The actuator 63 comprises a pair of forwardly extending latches 631 for being inserted into the receiving holes 612. Each latch 631 has a hook 632 perpendicularly and outwardly extending from a free end thereof for engaging with the locking hole 613 thereby biasing the inserted cable in contact with the terminals 62 retained in the housing 61. However, due to the miniaturization of the electrical connectors, the mechanical strength of the hook-like latches is marginal and thus the latches may break easily during assembly. Furthermore, such conventional latches also require that a great force be applied to mount the actuator to the housing, and this increases the time required for the assembly process.

The present invention is directed at solving these problems by providing an electrical connector for a flexible flat cable having a stuffer with latching members formed thereon which facilitate assembly and have increased strength.

SUMMARY OF THE INVENTION

Accordingly, one object of the present invention is to provide an electrical connector for a flexible flat cable having a stuffer with latching members formed thereon for facilitating assembly to a housing thereof thereby increasing assembly efficiency.

Another object of the present invention is to provide an electrical connector for a flexible flat cable having a stuffer with increased strength for preventing the stuffer from breaking thereby ensuring a reliable connection with the inserted flexible flat cable.

To fulfill the above-mentioned objects, an electrical connector for a flexible flat cable comprises a dielectric housing defining an elongate slot, a plurality of terminals retained in the housing, a shield enclosing the housing, and a stuffer received in the elongate slot of the housing. The housing has a pair of receiving cavities defined on opposite ends of the elongate slot. Each terminal has a tail portion including upper and lower fingers for connecting with signal conductors of the inserted cable. The shield comprises a pressing plate connecting with a bottom wall thereof via a pair of linkers and parallel to the bottom wall. The pressing plate extends into the elongate slot of the housing for biasing the flexible flat cable in contact with the terminals retained in the housing.

The stuffer comprises a body and a pair of spring latch arms formed on opposite ends thereof. A latching member is formed on an outer surface of each latch arm for guiding and locking the stuffer into the housing. The latching member includes a lead-in ramp outwardly projecting from the latch arm, a locking section defined at a rear end of the lead-in ramp, and a guiding rib extending rearward from an upper edge of the lead-in ramp. The lead-in ramp and the guiding rib sequentially guide the latch arm into a corresponding receiving cavity of the housing thereby facilitating assembly of the stuffer to the housing. The locking section snaps over a locking member formed on an inner side surface of the receiving cavity thereby engaging the stuffer with the housing. The latching members have certain minimum dimensions further designed to ensure the strength of the latch arm thereby preventing the latch arm from breaking.

The stuffer is first assembled to the shield. The stuffer-shield subassembly is then engaged with the housing in a first, loading position. After the flexible flat cable is inserted into a gap defined between the pressing plate of the shield and the upper fingers of the terminals retained in the housing, the stuffer is further pushed inward to a final, terminating position. In the final, terminating position, the stuffer presses against the pressing plate of the shield to force the pressing plate into contact with grounding conductors of the inserted cable thereby forcing the upper fingers of the tail portions of the terminals into contact with signal conductors of the cable.

Other objects, advantages and novel features of the invention will become more apparent from the following detailed description when taken in conjunction with the accompanying drawings.

DETAILED DESCRIPTION OF THE INVENTION

Figure 1:
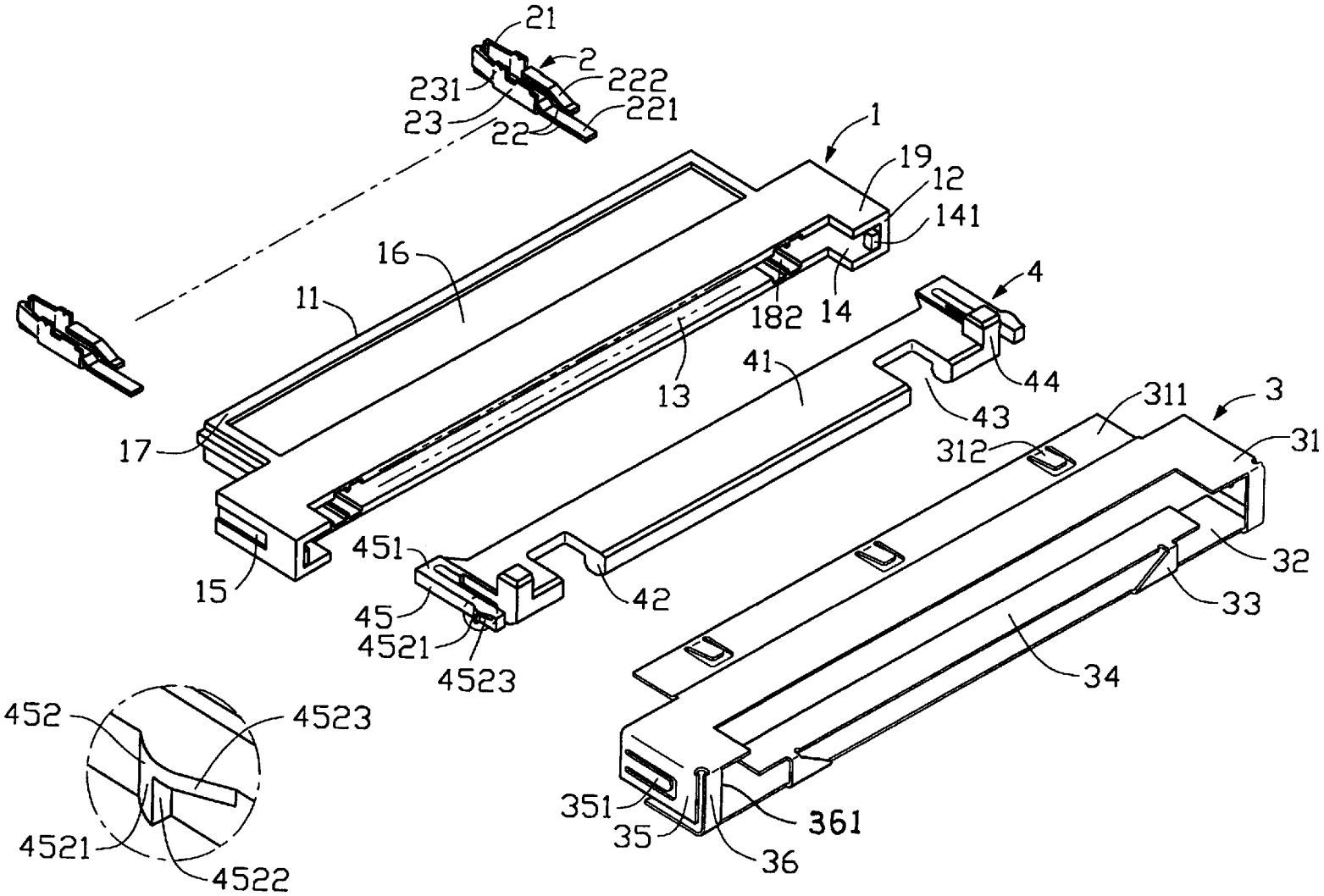
FIG. 1 is an exploded view of an electrical connector for a flexible flat cable in accordance with the present invention.

Referring to FIG. 1, an electrical connector for a flexible flat cable 5 (FIG. 4) in accordance with the present invention comprises a dielectric housing 1, a plurality of terminals 2 retained in the housing 1, a shield 3 enclosing the housing 1, and a stuffer 4 inserted into the housing 1.

The housing 1 has a mating surface 11 for connecting with a complementary connector (not shown), and a mounting surface 12 opposite the mating surface 11 for receiving the stuffer 4. A plurality of passageways 18 (FIG. 3) having a stepped portion 182 is defined between the mating surface 11 and the mounting surface 12 for receiving the terminals 2. A shallow recess 16 is defined in an upper surface 17 of the housing 1. An elongate slot 13 is defined in the mounting surface 12 in communication with the passageways 18. A pair of receiving arms 19 extends rearward from opposite ends of the housing 1 with a receiving cavity 14 defined therein in communication with the elongate slot 13. A locking member 141 is formed on an inner surface of each receiving arm 19 proximate the mounting surface 12. A groove 15 is defined in an outer surface of each receiving arm 19.

Each terminal 2 is unitarily stamped to include a U-shaped mating portion 21 at one end thereof, a tail portion 22 including upper and lower fingers 222 and 221 at the other end thereof, and a retaining portion 23 between the mating portion 21 and the tail portion 22. Barbs 231 are formed on the retaining portion 23 for being interferentially fit in the corresponding passageway 18 of the housing 1. The upper finger 222 is shorter than the lower finger 221 and has a curved end bent toward the lower finger 221.

Figure 3:
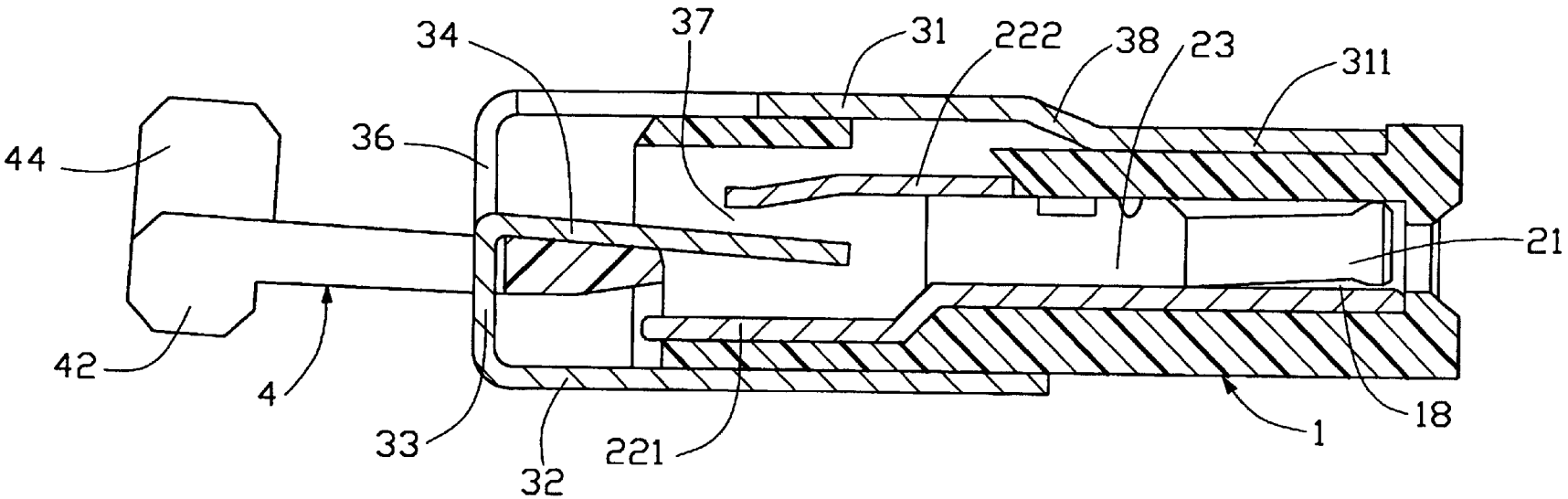
FIG. 3 is a cross-sectional view taken along line 3—3 of FIG. 2.

The shield 3 is unitarily stamped to include a top wall 31, a bottom wall 32, and a pair of lateral walls 35 for cooperatively defining a space to accommodate the housing 1 thereby shielding the housing 1 from EMI. Each lateral wall 35 comprises a spring finger 351 stamped therefrom for engaging with the corresponding groove 15 of the housing 1. The bottom wall 32 connects with the top wall 311 via a pair of interconnecting portions 36 proximate the lateral wall 35. The shield 3 further includes an elongate fixing plate 311 parallel to the bottom wall 32 and connecting with the top wall 31 via an inclined transition portion 38 (FIG. 3). Three upwardly stamped lances 312 are formed in the fixing plate 311 for engaging with a corresponding grounding part of the complementary connector. An elongate pressing plate 34 is connected with a rear edge of the bottom wall 32 via a pair of linkers 33 and is parallel to the bottom wall 32.

The stuffer 4 includes an elongate body 41 and a pair of spring latch arms 45 at opposite ends of the body 41. The body 41 comprises an elongate flange 42 downwardly projecting from a rear edge thereof. A pair of cutouts 43 is defined in the rear edge of the body 41 on opposite sides of the flange 42. A pair of protrusions 44 is formed on opposite ends of the body 41 adjacent to the latch arms 45. Each latch arm 45 connects with the body 41 via a bridge 451 thereof and is spaced apart from the body 41 to be resilient. A latching member 452 is integrally formed on an outer surface of each latch arm 45 for guiding and locking the latch arm 45 into the corresponding receiving cavity 14 of the housing 1. The latching member 452 includes a lead-in ramp 4521 outwardly projecting from the outer surface of the latch arm 45, a locking section 4522 defined at a rear end of the lead-in ramp 4521, and a guiding rib 4523 extending rearward from an upper edge of the lead-in ramp 4521.

Figure 2:
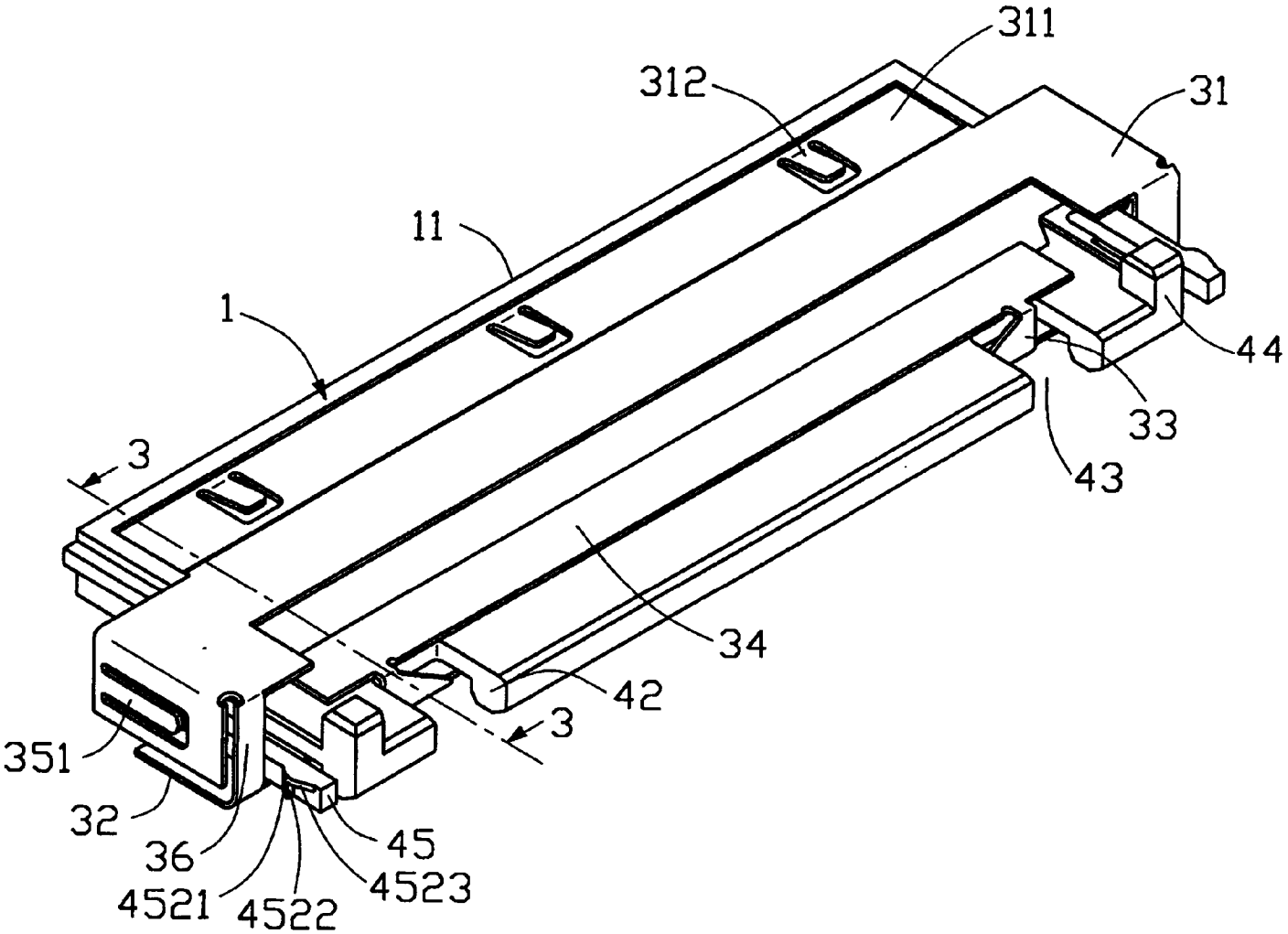
FIG. 2 is an assembled view of FIG. 1 with a stuffer thereof in a first, loading position.

FIGS. 2 and 3 show an assembled connector of the present invention in a first, loading position before the flexible flat cable 5 is inserted therein. In assembly, the terminals 2 are inserted into the corresponding passageways 18 from the mounting surface 12 of the housing 1 with the tail portions 22 resting within the stepped portions 182 of the passageways 18.

To assemble the stuffer 4 into the shield 3, the body 41 of the stuffer 4 is inserted between the pressing plate 34 and the bottom wall 32 of the shield 3. The flange 42 and the protrusions 44 protrude rearward from the shield 3, and the cutouts 43 receive the corresponding linkers 33 of the shield 3. The free ends of the latch arms 45 also protrude rearward from the shield 3 and abut against inner edges of the interconnecting portions 36 of the shield 3.

To assemble the stuffer-shield subassembly to the housing 1, the shield 3 encloses the housing 1 with the fixing plate 311 thereof resting within the shallow recess 16 of the housing 1 and the spring fingers 351 thereof engaged with the corresponding grooves 15 of the housing 1.

In this first, loading position, a gap 37 is defined between the pressing plate 34 of the shield 3 and the upper fingers 222 of the terminals 2 for extension of the flexible flat cable 5.

Figure 4:
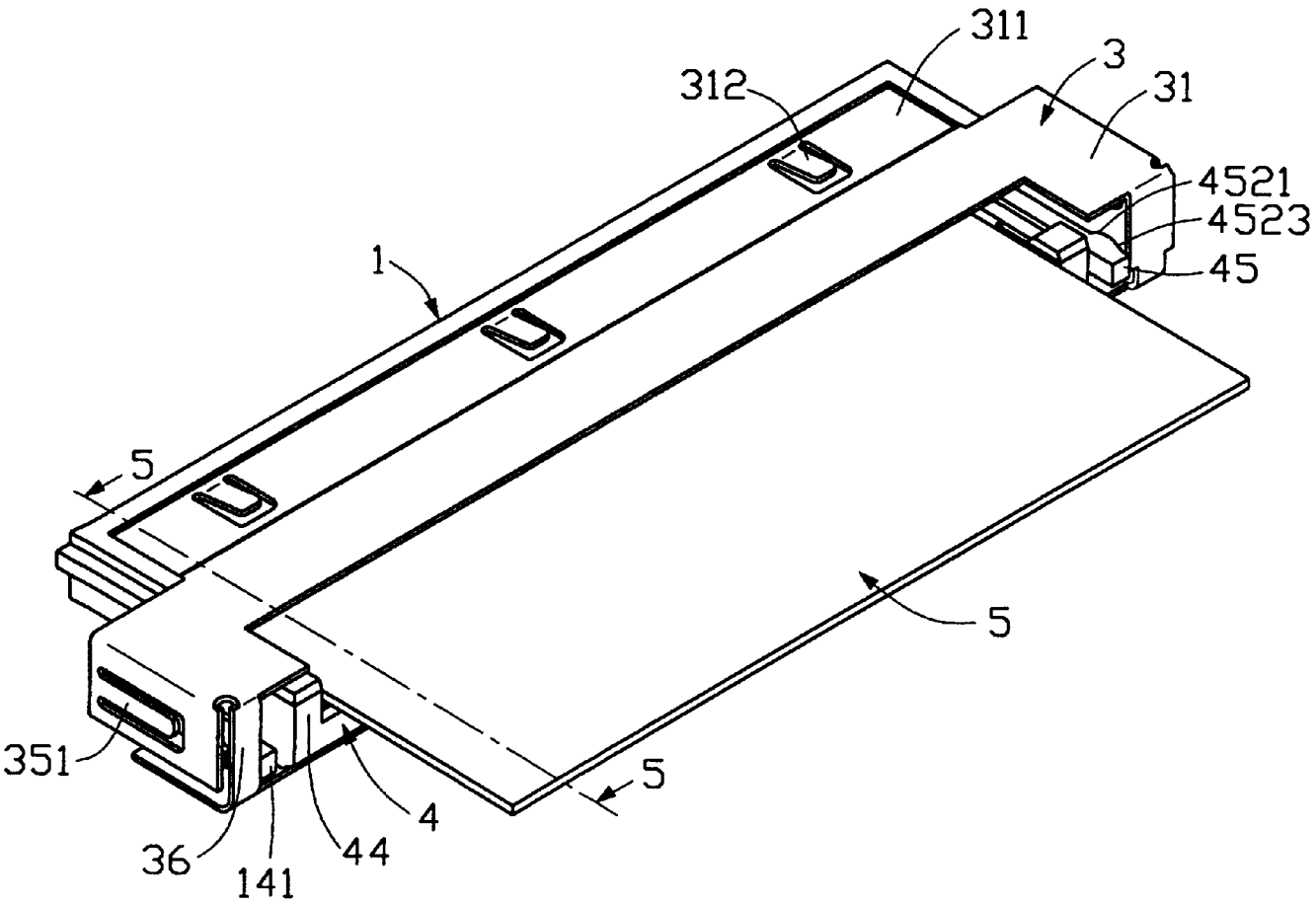
FIG. 4 is a view similar to FIG. 2 but with a flexible flat cable inserted into the connector and with the stuffer thereof in a final, terminating position.
Figure 5:
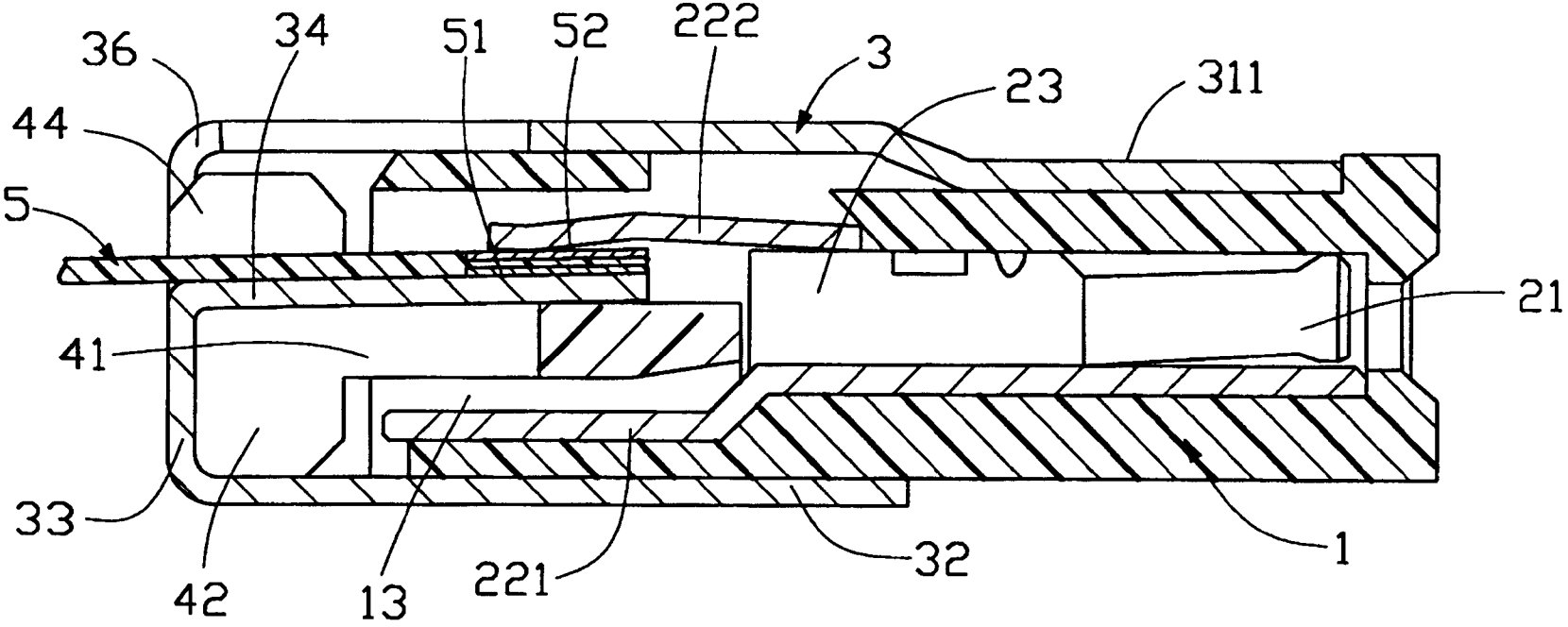
FIG. 5 is a cross-sectional view taken along line 5—5 of FIG. 4.
Figure 6:
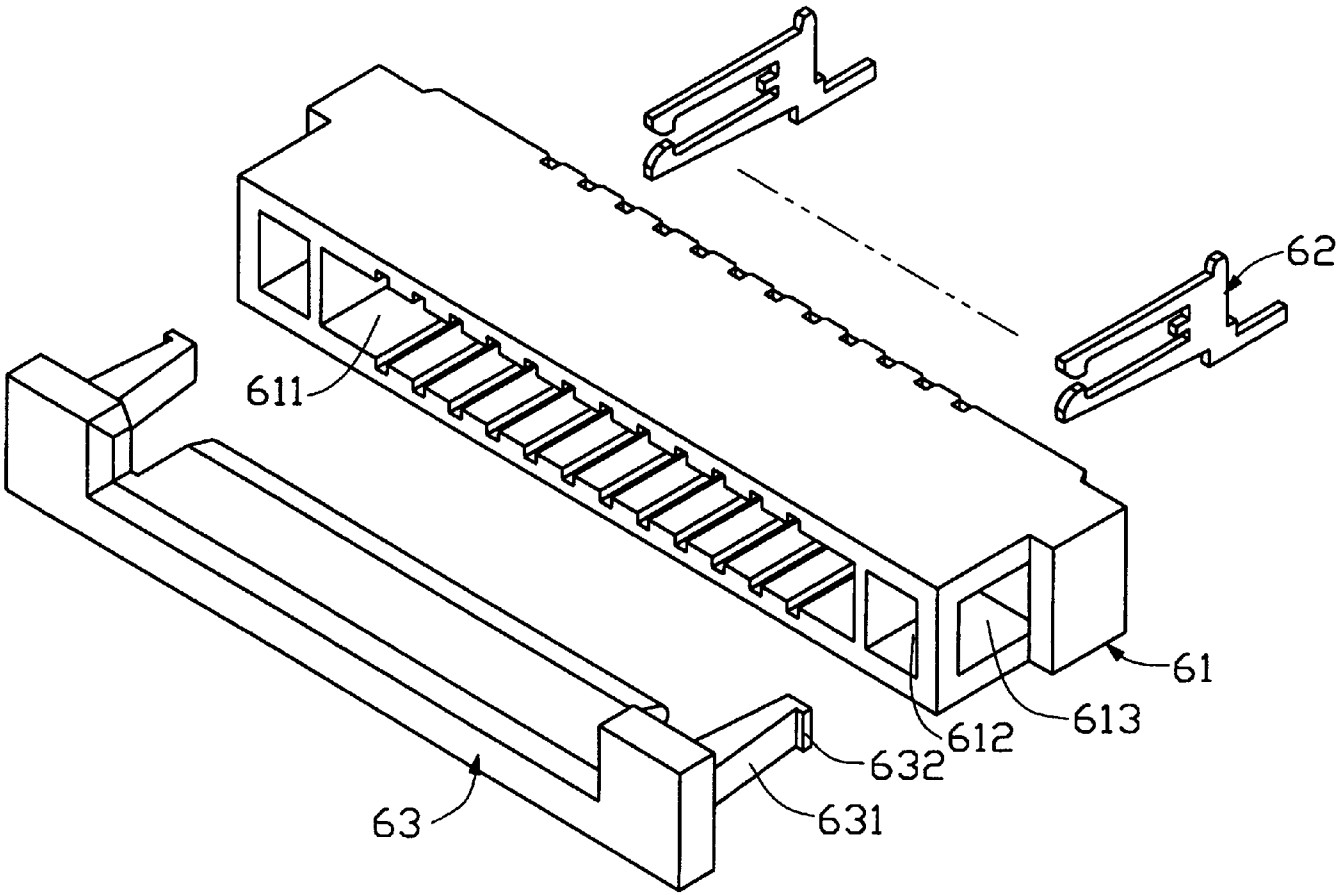
FIG. 6 (PRIOR ART)
FIG. 6 is an exploded view of a conventional electrical connector for a flexible flat cable having hook-like latches formed on an actuator thereof.

FIGS. 4 and 5 show the assembled connector of the present invention in a final, terminating position where the flexible flat cable 5 is retained therein. In assembly, a leading edge of the flexible cable 5 is inserted into the gap 37 of the connector from a rear edge of the connector. The leading edge of the flexible cable 5 includes grounding conductors 51 on a side thereof facing the pressing plate 34 of the shield 3 and signal conductors 52 on an opposite side thereof facing the upper fingers 222 of the terminals 2. The shield 3 is further pushed inward from the first, loading position to the final, terminating position. During this process, the lead-in ramps 4521 and the guiding ribs 4523 of the latching members 452 sequentially guide the latch arms 45 of the stuffer 4 into the corresponding receiving cavities 14 of the housing 1. The locking sections 4522 of the latching members 452 snap over the corresponding locking member 141 in the receiving cavities 14 and the protrusions 44 of the body 41 abut against the housing 1 to prevent a further forward movement of the stuffer 4 thereby securely engaging the stuffer 4 with the housing 1.

In this final, terminating position, the flange 42 of the stuffer 4 is pushed into a space defined between the pressing plate 34 and the bottom wall 32 of the shield 3. The inserted flange 42 forces the pressing plate 34 to upwardly bias against the grounding conductors 51 of the flexible cable 5 thereby forcing the signal conductors 52 of the flexible cable 5 to contact the upper fingers 222 of the terminals 2. Thus, a reliable electrical connection between the flexible flat cable 5 and the terminals 2 is established.

Due to the provision of the lead-in ramps 4521 and the guiding ribs 4523 of the latching members 452 on the latch arms 45 of the stuffer 4, the requirement of a great force applied to assemble the stuffer 4 to the housing 1 is avoided thereby facilitating assembly and increasing assembly efficiency. Because the latching members 452 have certain minimum dimensions, they increase the strength of the latch arms 45 to prevent the latch arms 45 from breaking thereby ensuring a reliable connection between the inserted flexible flat cable 5 and the terminals 2. It is noted that curved configuration of the guiding rib 4523 also provides a lead-out function, when the stuffer 4 is required to be temporarily moved out of the space for re-loading the flexible flat cable 5, for not being blocked by the edge section 361 of the interconnecting portion 36 of the shield 3.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for a flexible flat cable comprising:

a dielectric housing having a plurality of passageways, a slot defined in a rear end thereof in communication with the passageways;

a plurality of terminals retained in the passageways, each terminal having a tail portion;

a metal shield enclosing the housing and including a pressing plate extending into the slot of the housing; and a stuffer confined to be movable between the dielectric housing and the shield for biasing the pressing plate of the shield in contact with a flexible flat cable inserted into a gap defined between the tail portions of the terminals and the pressing plate;

wherein the housing defines a pair of receiving cavities on opposite ends of the slot, each receiving cavity of the housing having a locking member formed on an inner side surface thereof;

wherein the stuffer comprises a body and a pair of spring latch arms on opposite ends of the body, each latch arm having a latching member formed thereon for guiding and locking the latch arm into a corresponding receiving cavity of the housing;

wherein each latch arm of the stuffer is spaced from the body and is connected to the body by a bridge;

wherein the latching member of the latch arm includes an outwardly projecting lead-in ramp, a locking section defined at a rear end of the lead-in ramp, and a guiding rib extending rearwardly from an upper edge of the lead-in ramp, the lead-in ramp and the guiding rib sequentially guiding the latch arm into a corresponding receiving cavity of the housing, the locking section engaging with corresponding locking member of the receiving cavity;

wherein the body of the stuffer has a pair of protrusions formed on opposite ends thereof for preventing a further forward movement of the stuffer toward the housing;

wherein the body of the stuffer comprises a downwardly projecting flange for biasing the pressing plate of the shield in contact with the inserted flexible flat cable;

wherein the shield includes a top wall, a bottom wall and a pair of lateral walls, the bottom wall connecting with the top wall by a pair of interconnecting portions proximate the lateral walls, each interconnecting portion having an inner edge abutting against the latch arm of the stuffer;

wherein the pressing plate of the shield connects with the bottom wall by a pair of linkers and is parallel to the bottom wall, and wherein the body of the stuffer defines a pair of cutouts in a rear edge thereof for receiving the linkers of the shield therein.

* * * * *